US006756905B2

(12) United States Patent
Rattman et al.

(10) Patent No.: US 6,756,905 B2
(45) Date of Patent: Jun. 29, 2004

(54) PHOTOELECTRIC SMOKE DETECTOR AND CHAMBER THEREFOR

(75) Inventors: William Rattman, Orland, FL (US); Zhexin Mi, Toronto (CA)

(73) Assignee: Digital Security Controls Ltd., Concord (CA)

( * ) Notice: Subject to any disclaimer, the term of this patent is extended or adjusted under 35 U.S.C. 154(b) by 37 days.

(21) Appl. No.: 09/751,401

(22) Filed: Jan. 2, 2001

(65) Prior Publication Data

US 2002/0084907 A1 Jul. 4, 2002

(51) Int. Cl.[7] ..... G08B 21/00

(52) U.S. Cl. ..... 340/630; 340/628; 340/698.6; 340/693.12; 250/574

(58) Field of Search ..... 340/628, 630, 340/578, 693.6, 629, 693.5, 693.9, 693.12; 250/574, 573; 356/338

(56) References Cited

U.S. PATENT DOCUMENTS 5,486,816 A * 1/1996 Ariga et al. ..... 340/630
5,546,074 A * 8/1996 Bernal et al. ..... 340/630
6,195,014 B1 * 2/2001 Sakurai et al. ..... 340/630
6,288,647 B1 * 9/2001 Yamano ..... 340/630
6,300,876 B1 * 10/2001 Sakurai et al. ..... 340/630
2002/0089426 A1 7/2002 Qualey et al.

* cited by examiner

*Primary Examiner*—Toan Pham

(57) ABSTRACT

A smoke detection chamber for use in a photoelectric smoke detector. The smoke detection chamber comprises a side wall with a double row of generally rectangular vanes arranged to provide a labyrinth extending generally around the entire side wall for ingress and egress of smoke particles, a top and a bottom. A mounting arrangement for a photoemitting diode is provided in the side wall of the smoke detection chamber so that a light beam from a photoemitting diode is transmitted across the smoke detection chamber. The mounting arrangement extends from and is spaced from the bottom to provide minimal interference for entry of smoke particles. The bottom of the smoke detection chamber has an opening therein with a shielding arrangement thereabout open to the chamber for a photodiode detector, the opening and shielding arrangement being located between the centerline of the smoke detection chamber and the mounting arrangement in the side wall of the chamber. The double vane side wall and spacing of the mounting arrangement from the bottom provides the smoke detection chamber with generally uniform smoke penetration properties around its entire periphery.

15 Claims, 5 Drawing Sheets

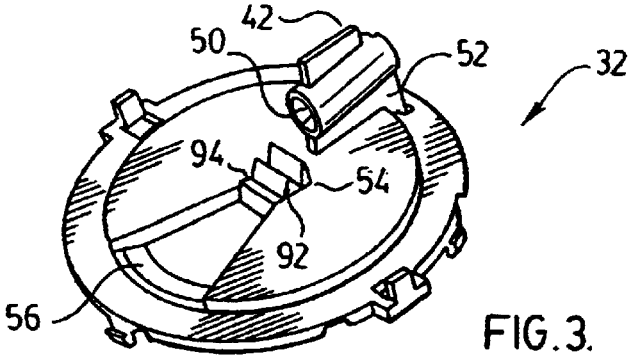
FIG.3.
FIG.4.
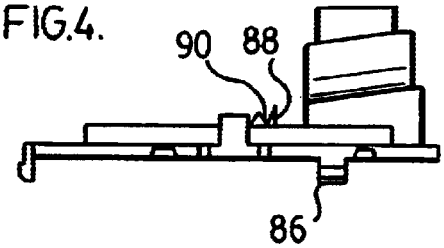
FIG.4A.
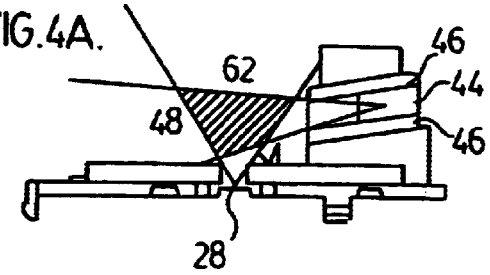
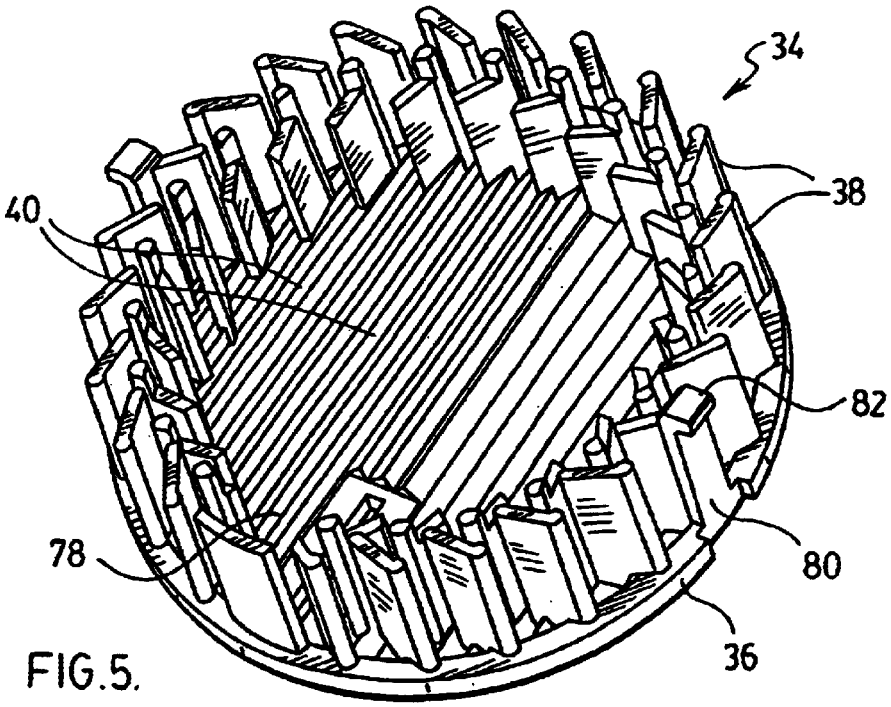
FIG.5.

PHOTOELECTRIC SMOKE DETECTOR AND CHAMBER THEREFOR

FIELD OF THE INVENTION

The present invention is directed to photoelectric smoke detectors and in particular to photoelectric smoke detectors having a smoke detection chamber with generally uniform smoke penetration properties around its entire periphery.

BACKGROUND OF THE INVENTION

Smoke detectors based on light scattering by smoke particles have been known for a number of years. Such detectors at present utilize solid state components including photoemitting diodes and photodiode detectors, the two devices being incorporated in a fixed mounted arrangement within a smoke detection chamber. The smoke detection chamber is generally designed to exclude most ambient light influences while providing openings to permit entry of the smoke particles into the detection chamber.

There have been many designs of light scattering smoke detectors developed and patented which rely upon the walls of the smoke chamber having labyrinth designs to allow the passage of the smoke particles while excluding ambient light from the interior of the chamber. Examples of such designs are shown in U.S. Pat. Nos. 3,914,616, 4,168,438, 4,216,377, 4,672,217, 4,758,733, 5,138,302, 5,400,014, 5,430,307, 5,543,777, 5,546,074, 5,552,765 and 5,642,099.

In many of the chambers of the above noted patents, the photoemitting diodes and photodiode detectors are mounted in either the sides of the chamber or on the bottom of the chamber, most typically with a 60° scattering angle along a horizontal plane between the photoemitting diodes and photodiode detectors. The design of many of the prior art smoke detection chambers results in a generally horizontal flow of the smoke particles through the chamber. Ideally, the photoemitting diode and photodiode detector should be mounted in such a way that the intersection of the transmitted light from the photoemitting diode and the view of the photodiode detector falls within the horizontal path of the smoke particles. However, depending upon the direction of the smoke particles and their laminar flow rate through the chamber, the horizontal flow may be shifted from the intersection thereby affecting the sensitivity of the smoke detector. Also, the use of the 60° scattering angle increases the distance between the photodiode detector and photoemitting diode thereby affecting the sensitivity and increasing the potential for dust particle interference.

Smoke detectors utilizing a generally perpendicular scattering angle have greater sensitivity as it is possible to mount the photoemitting diode and photodiode detector closer to each other to increase the amount of light in the detection zone. Such designs generally require the photoemitting diode to be mounted in the side wall of the smoke detection chamber. Examples of such smoke detectors are shown in U.S. Pat. No. 3,914,616, and the applicants previous U.S. Pat. No. 5,719,557.

In both the 90° scattering angle designs as well as a number of the 60° scattering angle designs, one or both of the photoemitting diode and photodiode detector are mounted in the side wall. The mounting of one or both of the elements in the side wall of the smoke detection chamber results in a large solid area in the side wall which acts as a block and does not permit easy passage of smoke particles into the chamber. In order for the smoke particles to enter the chamber, they have to go around the solid area block.

Depending upon the size of such solid area blocks, there can be a 20% or more difference in sensitivity of the smoke detector when the direction of the smoke flow is at the region of the solid area block compared to when the smoke direction is from the side which does not have such a solid area block.

In order to achieve optimum detection of smoke particles in a fire situation, the smoke detector should be responsive to the presence of smoke from any direction. Variations in responsiveness to smoke from different directions can cause a delay in the annunciation of an alarm condition by the smoke detector. This could result in the fire condition being more advanced when the alarm is given and could result in the occupants of the space in which the smoke detector is located having less time in which to vacate the space.

One way some of the prior art detectors have tried to alleviate the problem of variations in responsiveness is by making the side wall of the chamber less "open" throughout its periphery. For example, U.S. Pat. Nos. 4,216,377 and 4,672,217 both illustrate smoke detection chambers having "scoop fins" with very large legs and small spaces between the legs. Similarly, U.S. Pat. Nos. 4,758,733, 5,138,302, and 5,546,074 all describe smoke detection chambers in which a significant portion of the area of the side wall is filled by labyrinth wall elements resulting in reduced open areas through which the smoke particles can pass.

Another problem faced by photoelectric smoke detectors relates to the nature of the smoke particles to be detected. Smoke is generally classified as black or gray. Gray smoke particles are generally much easier to detect as they tend to scatter the light from the photoemitting diode very well. Hence, most designs of photoelectric smoke detectors are reasonably effective at detecting gray smoke. Black smoke particles, on the other hand, do not generally scatter the light as well and many designs of photoelectric smoke detectors have difficulty properly detecting the presence and level of black smoke. This is particularly the case with those detectors utilizing a 60° scattering angle as, at this angle, the gray smoke to black smoke sensitivity is only 4:1. In these detectors which are usually set to detect gray smoke at about 3% per foot obscuration, the level of black smoke required to indicate an alarm state would be 12% per foot obscuration or higher. Thus, there still exists a need to provide very sensitive smoke detection of both black and gray smoke particles with generally uniform responsiveness to smoke from any direction.

SUMMARY OF THE INVENTION

The present invention in one aspect provides for a photoelectric smoke detector comprising a case having mounted therein a circuit board and a smoke detection chamber. The smoke detection chamber has a side wall, a top and a bottom. The side wall is provided with a double row of generally rectangular vanes arranged to provide a labyrinth extending generally around the entire periphery of the smoke detection chamber for ingress and egress of smoke particles. A photoemitting diode is mounted in a mounting arrangement in the side wall of the smoke detection chamber so that a light beam from the photoemitting diode is transmitted across the smoke detection chamber. The mounting arrangement extends from and is spaced from the bottom on a narrow strut to provide minimal interference for entry of smoke particles. The bottom of the smoke detection chamber has an opening therein with a shielding arrangement thereabout open to the chamber. The circuit board is mounted to overlie the bottom surface and includes a photodiode detector mounted directly thereon and positioned generally in the opening so that it views into the smoke detection chamber through the opening and the shielding arrangement, the shielding arrangement shielding the photodiode detector from incident light which may be present in the smoke detector chamber while providing for a diverging field of view of the photodiode detector which intersects the light beam of the photoemitting diode to define a detection volume contained within the smoke detection chamber. The double vane side wall and spacing of the mounting arrangement from the bottom provides the smoke detection chamber with generally uniform smoke penetration properties around its entire periphery.

In another aspect of the invention there is provided a smoke detection chamber for use in a photoelectric smoke detector. The smoke detection chamber comprises a side wall, a top and a bottom. The side wall is provided with a double row of generally rectangular vanes arranged to provide a labyrinth extending generally around the entire periphery of the smoke detection chamber for ingress and egress of smoke particles. A mounting arrangement for a photoemitting diode is provided in the side wall of the smoke detection chamber so that a light beam from a photoemitting diode is transmitted across the smoke detection chamber. The mounting arrangement extends from and is spaced from the bottom on a narrow strut to provide minimal interference for entry of smoke particles. The bottom of the smoke detection chamber has an opening therein with a shielding arrangement thereabout open to the chamber for a photodiode detector. The double vane side wall and spacing of the mounting arrangement from the bottom provides the smoke detection chamber with generally uniform smoke penetration properties around its entire periphery.

In yet another aspect of the invention, the smoke detection chamber is provided as a bottom having the opening and shielding arrangement and a vane extending upwardly to which is attached the mounting arrangement for a photoemitting diode and a top having the double row of rectangular vanes extending downwardly therefrom, the top with the downwardly extending vanes being releasably attachable to the bottom to form the smoke detection chamber.

BRIEF DESCRIPTION OF THE DRAWINGS

Preferred embodiments of the present invention are illustrated in the attached drawings in which:

FIG. 3 is a perspective view of the bottom of the smoke detection chamber of the present invention;

FIG. 4 is a side elevation view of the bottom of the smoke detection chamber of the present invention;

FIG. 5 is perspective view of the top and attached side wall of the smoke detection chamber;

DETAILED DESCRIPTION OF THE PREFERRED EMBODIMENTS

Figure 1:
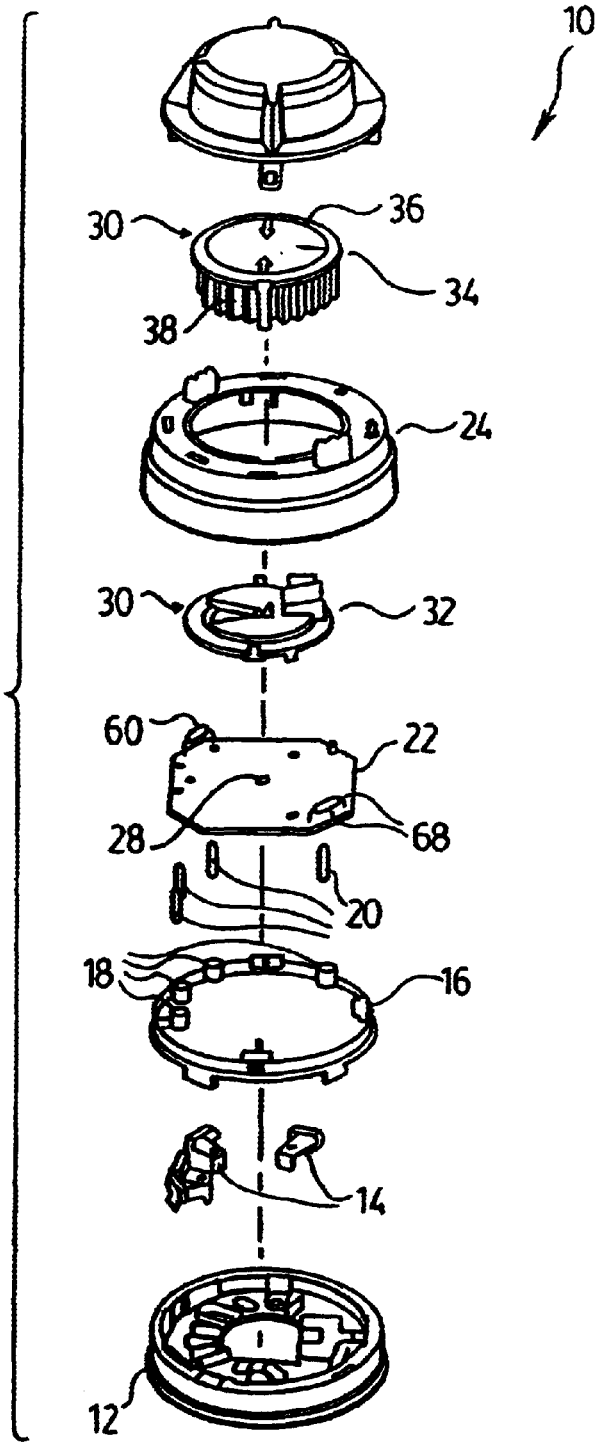
FIG. 1 is an exploded perspective view of a photoelectric smoke detector incorporating the smoke detection chamber of the present invention.
Figure 2:
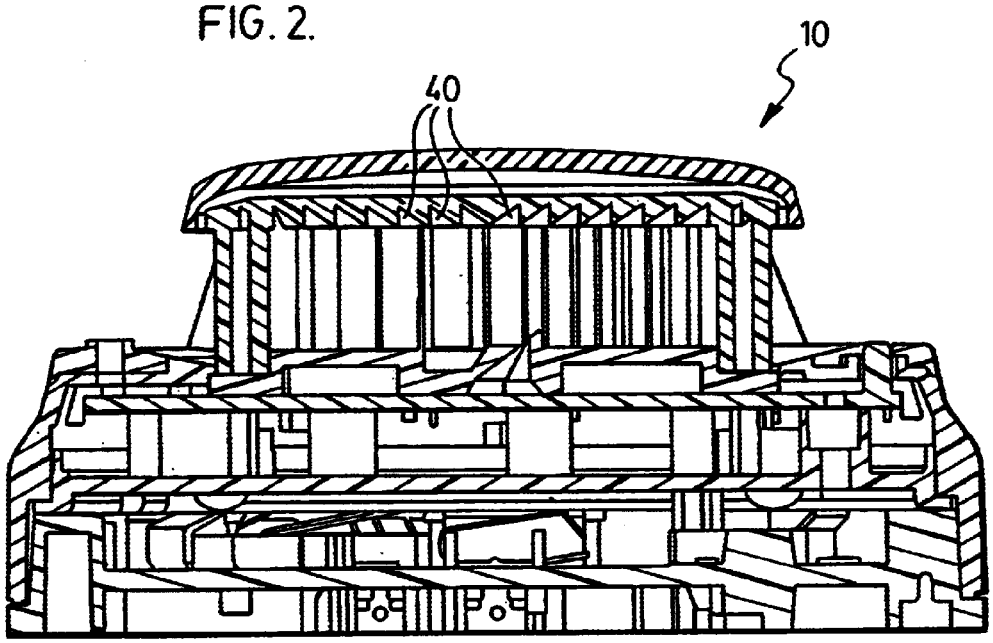
FIG. 2 is side elevation view in cross section of the smoke detector of FIG. 1.
Figure 6:
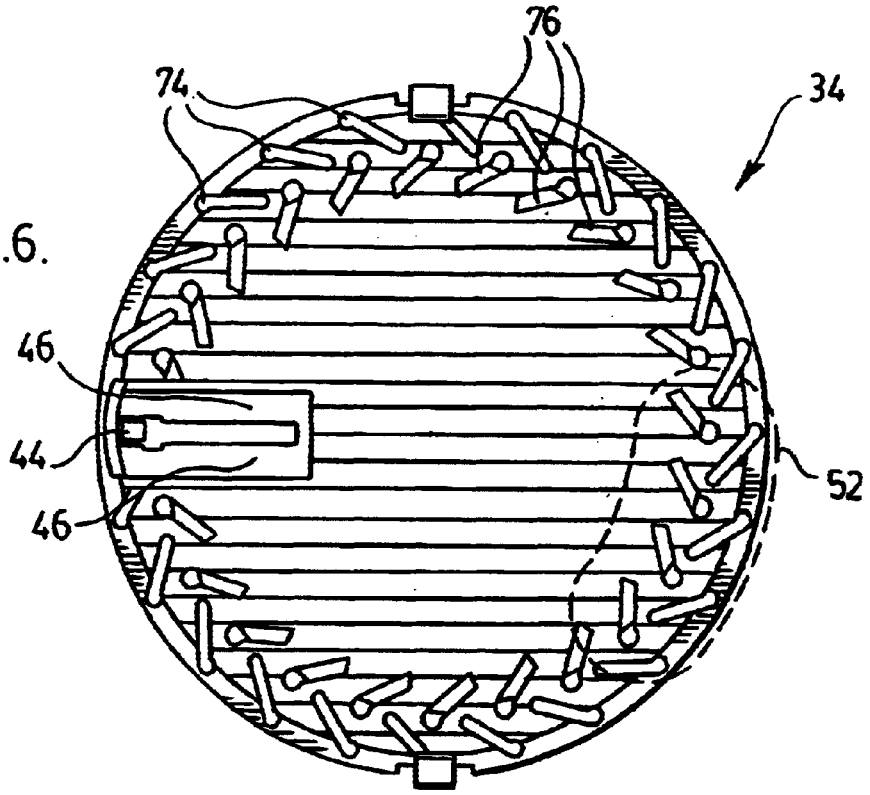
FIG. 6 is top plan view of the top of the smoke detection chamber.
Figure 7:
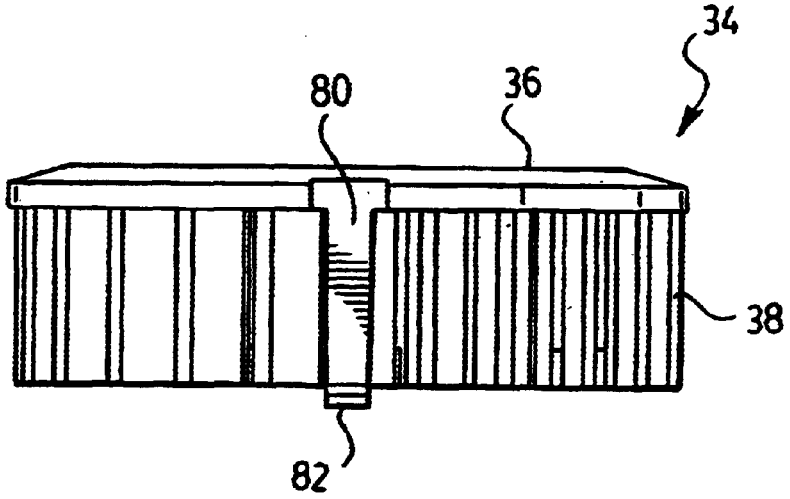
FIG. 7 is a side elevation view of the top of the smoke detection chamber.

As illustrated in the attached figures, the present invention is directed to photoelectric smoke detectors and in particular to photoelectric smoke detectors having a smoke detection chamber with generally uniform smoke penetration properties around its entire periphery. FIG. 1 illustrates an exploded perspective view of the smoke detector generally indicated by the numeral 10. The smoke detector 10 has a base 12 for mounting to a standard hexagon electrical box (not shown). The base 12 is provided with connectors 14 for connecting the wires providing power and communication for the smoke detector 10. Releasably attached to the base 12 is a base cover 16 which is provided with openings 18 through which pins 20 are inserted to provide electrical contact between the connectors 14 and the circuit board 22. Circuit board 22 is contained within a lower housing 24 which is attachable to and surrounds the base cover 16. Attached to the circuit board 22 is the smoke detection chamber 30 and in particular the bottom 32 of the smoke detection chamber 30.

The printed circuit board 22 has electronic components 26 which typically make up the smoke alarm circuitry mounted to one or both sides of the printed circuit board 22. Preferably electronic components 26 are surface mounted components. The details of the alarm circuitry are not shown as the design of such circuitry is within the knowledge of ordinary workers in the art of smoke alarm design. Mounted on the printed circuit board 22 is a photodiode detector 28 and a smoke detection chamber 30, particularly, the smoke detection chamber bottom 32. The photodiode detector 28 is mounted such that the it views into the smoke detection chamber 30 as will be described further below. The smoke detection chamber cover 34 comprising the top 36 and attached side wall 38 which is in turn relesably attached to the smoke detection chamber base 32. The details of the smoke detection chamber 30 comprised of the bottom 32 and cover 34 will be described in detail below.

The preferred embodiment of the smoke detection chamber 30 illustrated in the figures, is in the form of a cylinder preferably having an internal diameter between about 2 to 3 inches, however other shapes are possible. As shown in FIGS. 1 and 3, the smoke detection chamber 30 has a bottom 32 and a cover 34 made up of side wall 38 and top 36. As will be appreciated, when the smoke detection chamber 30 is mounted in the case 12 and the case 12 in turn mounted on the ceiling, the bottom 32 of the chamber 30 will in fact form the upper surface of the chamber 30, while the top 36 of the chamber 30 will form the lower surface. However for ease of understanding, these parts are named in relation to their attachment to the circuit board 22.

The smoke detection chamber 30 is preferably molded in more than one piece with the side wall 38 and top 36 making up the cover 34 molded as one piece and the bottom 32 with the structures for the optic elements, the photoemitting diode 44 and photodiode detector 28, molded as a separate piece which may be releasably attached to the cover 34 of the smoke chamber 30 as will be described herein below. This enables the portion of the smoke detection chamber 30 being most susceptible to dust and grease film buildup, namely the cover 34 having the sidewalls 38 and top 36, to be easily replaced in the field without affecting the characteristics of the optic elements.

To reduce the possibility of reflected light from decreasing the sensitivity of the smoke detector 10, the smoke detection chamber 30 is constructed of a dark colored plastic, usually a black plastic preferably having a gloss finish to reduce the attraction and attachment of dust particles. A particularly preferred material for the smoke detection chamber 30 is black ABS plastic.

To further reduce the possibility of reflection of light within the chamber 30, the smoke detection chamber 30 is preferably provided with reticulated structures 40 on the top 34. These reticulated areas 40 of the smoke detection chamber 30 reduce the possibility of reflection of light from the top 36 and in addition provide an area where any dust which may enter the smoke detection chamber 30 may collect without causing scattering of light to reflect and impinge upon the photodiode detector 28. These dust hiding areas are located such that they are not both in the path of the light beam from the photoemitting diode and also within the view of a photodiode detector as described herein below. While these areas may in one or the other of these locations, they are not located so as to satisfy both conditions.

Smoke detection chamber 30 on the bottom 32 is provided with a mounting arrangement 42 for a photoemitting diode 44 and a shielding arrangement 54 for the photodiode detector 28. Mounting arrangement 42 for the photoemitting diode 44 has a generally cylindrical shaped tunnel 50 mounted on a vane or narrow strut 52 extending from the bottom 32 of the smoke detection chamber 30 to reduce the solid area which can potentially block the ingress and egress of smoke particles. The cylindrical tunnel 50 has extending walls 46 to provide an extended tunnel within which is mounted the photoemitting diode 44. Extending walls 46 preferably extend beyond the end of the photoemitting diode 44 to bound or limit the outer rays of the beam of light 48 emitted by the photoemitting diode 44 to provide for a relatively narrow beam of light broadcasting across the smoke chamber 30. The cylindrical tunnel 50 of the mounting arrangement 42 provides for a generally near perpendicular scattering angle between the photoemitting diode 44 mounted in the cylindrical tunnel 50 and the photodiode detector 28 mounted in the bottom 32 of the smoke detection chamber. The extending walls 46 also provide for shielding of the light beam 48 of the photoemitting diode 44 to reduce the possibility of stray light from the photoemitting diode 44 shining directly onto the photodiode detector 28. More preferably, to bring the light beam 48 from the photoemitting diode 44 closer to the photodiode detector 28, the cylindrical tunnel 50 has a slight downward angle on the order of 10° or less to provide a light scattering angle of between about 80° and about 90°. Most preferably, the cylindrical tunnel 50 has a downward angle of about 8° to provide for a light scattering angle of about 82°. As the cylindrical tunnel 50 preferably has a slight downward angle, the bottom 32 of the smoke detection chamber 30 may be provided with a recessed ramp 56 to aid in dispersion of the light rays from the photoemitting diode 44.

Combinations of smoke detectors and heat detectors in the same housing are common. The bottom 32 of the smoke detection chamber 30 may be provided with openings 58 for mounting of suitable heat detectors 60 such as thermistors. One or more such heat detectors 60 may be mounted on the exterior of the smoke detection chamber 30 by providing an opening 58 adjacent one of the rectangular vanes 52 of the outer wall. Alternatively, the heat detectors 60 may be mounted within the side wall 38 by providing the opening 58 between the two rows of vanes 52 or they may be mounted within the smoke detection chamber 30 by providing an opening 58 interior of the chamber 30. Preferably, the heat detectors 60 are mounted on the circuit board 22 exterior of the smoke detection chamber 30.

Figure 9:
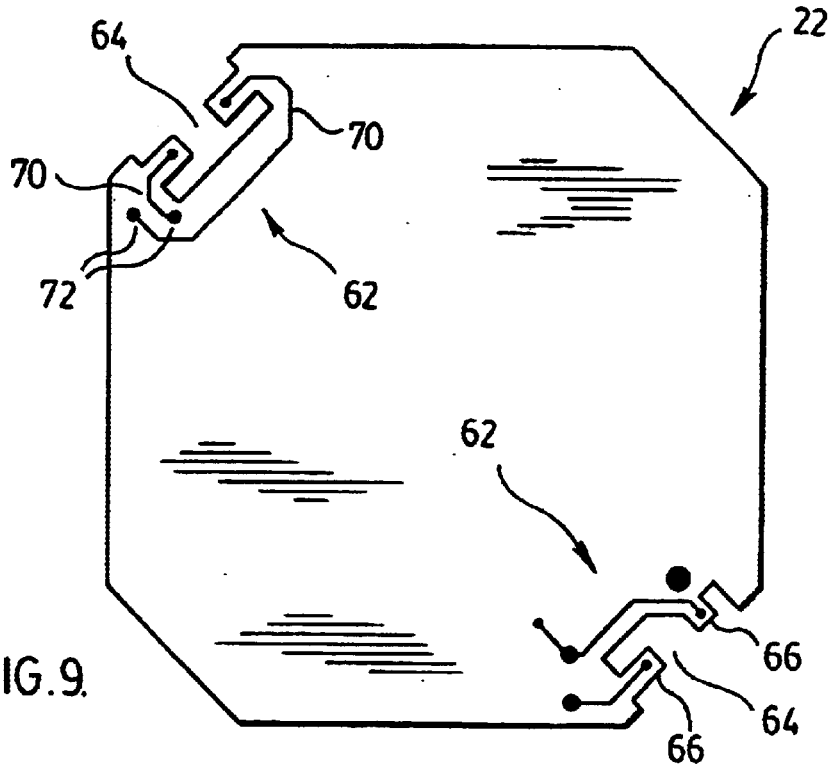
FIG. 9 is a top plan view of a preferred embodiment of a circuit board for use in the smoke detector of the present invention.

In a preferred embodiment, as shown in FIG. 9, the circuit board 22 is provided with mounting structures 62 for the heat detector 60 to maximize the detection capabilities of the heat detector 60 and minimize the heat sink properties of the circuit board connection for the heat detector. The mounting structures 62 of the circuit board 22 include a cut out 64 extending into the circuit board 22, the cut out 64 being provided with a mounting pad 66 for the heat detector leads 68 extending into the cut out 64 from the side. The cut out 64 provides for increased air flow around the heat detector 60 as there is no physical barrier of the circuit board 22 to impede the air flow. To further enhance the air flow around the heat detector 60, the heat detector 60 is provided with elongated leads 68 for mounting to the circuit board 22 to space the heat detector 60 further away from the plane of the circuit board 22. To reduce the heat sink properties of the connection between the heat detector 60 and the circuit board copper foil 70, the copper foil 70 leading from the heat detector leads 68 to the lands 72 of the circuit board 22 are reduced in width. To provide for sufficient current carrying properties, the copper foil 70 may be provided with a thin circular cross section.

To enable field replacement of the smoke detection chamber 30, the bottom 32 of the smoke detection chamber 30 is also provided with one half of a releasable securing means for releasably securing the cover 34 of the smoke detection chamber 30, being the side wall 38 and top 36, to the bottom. Preferably, the releasable securing means is a pair of complementary clips which engage one another to secure the cover to the bottom of the smoke detection chamber. An insect screen is fixedly mounted to the peripheral sidewall of the chamber and is removed simultaneously with the top and sidewall of the chamber.

The side wall 38 of the smoke detection chamber 30 has a double row of generally rectangular vanes 52 extending downwardly from the top 36 arranged to provide a labyrinth extending generally around the entire side wall 38 for ingress and egress of smoke particles. The outer row 74 of the rectangular vanes 52 extend inwardly at an acute angle from the exterior. The inner row 76 of rectangular vanes 52 are arranged spaced away from the outer row 74 and extend inwardly at an acute angle opposite the angle of the outer row 74. The inner and outer rows 76 and 74 respectively overlap such that if any of the rectangular vanes 52 of either the inner or outer row 74 or 76 were extended to contact the rectangular vane 52 of the other row, they would intersect the vane 52 inwardly of the end. In this way, the light blocking characteristics of the labyrinth are maintained while providing numerous clear paths for passage of smoke particles into and out of the smoke detection chamber 30. The double row of vanes 52 making up the side wall 38 of the smoke detection chamber 30 have minimal blockages for other structural elements. An opening 78 is provided in the side wall 38 for accepting the mounting arrangement 42 for the photoemitting diode 44 when the cover 34 is attached to the bottom 32. The structure of this mounting arrangement 42, as explained above, provides minimal restriction for the passage of smoke particles into or out of the smoke detection chamber 30. The other obstructions in the side wall 38 are the fingers 80 extending downwardly from the top 36 and having the clip 82 on the end for releasable attachment of the cover 34 to the bottom 32. The cross sectional area of the fingers 80 is kept to the minimum required to provide adequate support for the releasable engagement. All of these obstructions result in about a 5 percent reduction in the openness of the side wall 38 at the obstructions compared with other regions of the side wall 38. In other words, there is a 5 percent or less variation in the measurement of smoke detection sensitivity between smoke particles striking and entering the smoke detection chamber 30 at the obstructions as compared with smoke particles striking and entering the smoke detection chamber at other regions of the side wall 38.

Figure 8:
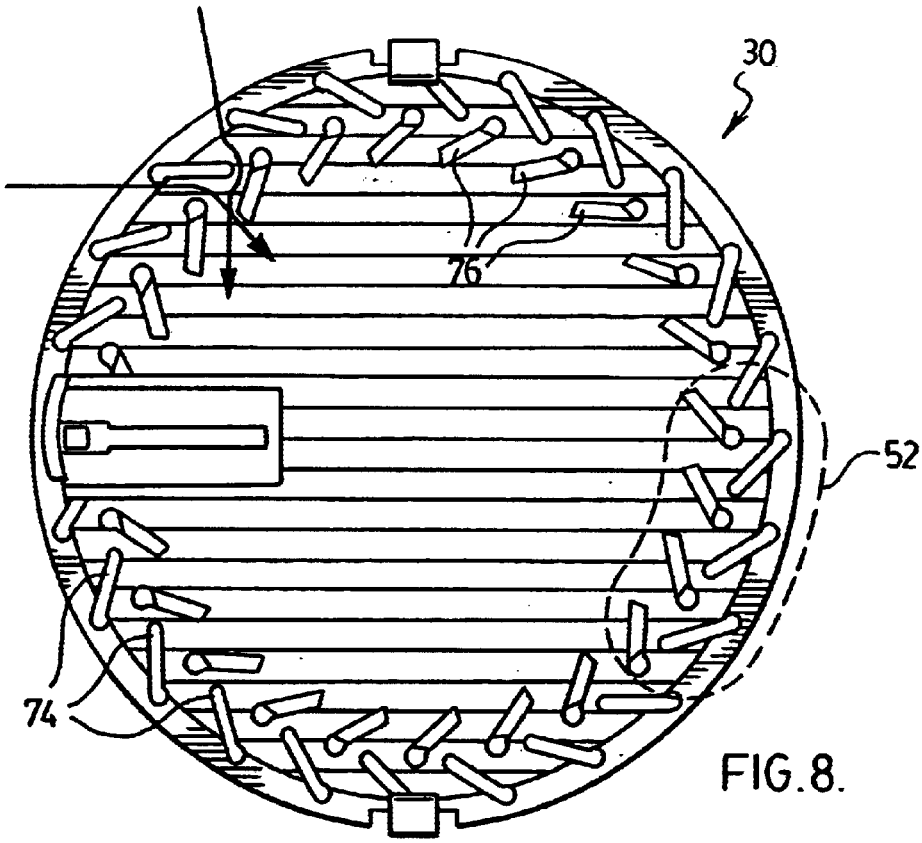
FIG. 8 is a top plan view of the interior of the smoke detection chamber illustrating the path of smoke particles and reflected light.

FIG. 8 illustrates the ease of entry of smoke particles through the double vane side wall 38 into the interior of the smoke detection chamber 30. As illustrated in the Figure, if the smoke particles strike the side wall 38 at a generally perpendicular angle, they easily pass through the spaces of the outer wall 74 of vanes 52 and strike the inner vanes 76 at an obtuse angle and are directed into the interior of the chamber 30. If the smoke particles strike the side wall 38 at an acute angle, generally parallel to the angle of the vanes of the outer wall 74, they pass through the openings between the vanes of the inner and outer walls 76 and 74 and are directed into the interior of the chamber 30 by the angled inner set of vanes.

The smoke detection chamber 30 is preferably mounted directly on the printed circuit board 22 by means of mounting clips 86 inserted through openings provided in the printed circuit board 22. The bottom 32 of the smoke detection chamber 30 is provided with an opening having the shielding arrangement 54 to overlie the photodiode detector 28 mounted on the printed circuit board 22. The shielding arrangement 54 is of a shape to reduce the possibility of incident light falling onto the photodiode detector 28. The shielding arrangement 54 may be of any suitable shape, for example a right circular cylinder having openings in the top and bottom or a rectangular or square structure with an open top and bottom. In the embodiment illustrated in the figures, the shielding arrangement 54 is a square shaped structure having an open top and bottom. The wall 88 of the shielding arrangement closest to the position of the photoemitting diode 44 is of a height to prevent any stray incident light from the photoemitting diode 44 from falling directly on the photodiode detector 28. This wall 88 may be provided with a reticulated groove 90 for holding any dust particles which may come in contact with the shielding arrangement 54 and hiding such dust particles from the field of view of the photodiode detector 28. The wall 92 farthest away from the photoemitting diode 44 has a height or shape to prevent any incident light which may enter the chamber 30 through the side wall 38 from falling on the photodiode detector 28. Wall 92 may also be provided with an inclined portion 94 to provide for increased shielding of the photodiode detector 28 from any incident light which may enter the smoke chamber 30.

The photodiode detector 28 contained within the shielding arrangement 54 has a field of view 62 which intersects the light beam 48 of the photoemitting diode 44 generally close to the perpendicular in a vertical plane to provide for the detection volume to be located within the smoke detection chamber 30 close to both the photoemitting diode 44 and photodiode detector 28 yet spaced from the surfaces of the smoke detection chamber 30 to minimize the effect on the photodiode detector 28 of light from the photoemitting diode 44 which is reflected exterior to the detection volume. The arrangement of the photoemitting diode 44 and photodiode detector 28 with a scattering angle at or close to a generally right angle in the vertical plane permits the detection volume to be located close to the photoemitting diode 44 where the intensity of the light beam from the photoemitting diode 44 is higher and close to the photodiode detector 28 where its sensitivity is higher thereby increasing the overall sensitivity of the smoke alarm 10. In addition, the use of the scattering angle near a generally right angle results in a black smoke to gray smoke sensitivity ratio of about 3.5:1, increasing the sensitivity to the presence of black smoke particles.

To achieve the above, the shielding arrangement 54 is near the centre of the smoke detection chamber 30, thus not interfering with smoke entry at the periphery of the chamber 30. The shielding arragement 54 is preferably located such that its centerline is near the centre of the chamber 30, but between the centerline of the smoke detection chamber 30 and the mounting arrangement 42. Preferably the shielding arrangement 54 is located such that its centerline is located within 0.5 inches or less of the end of the mounting arrangement 42, more preferably approximately 0.3 to 0.4 inches away from the mounting arrangement 42. This location is possible because of the use of the scattering angle close to or at a generally right angle places the photodiode detector 28 close to the photoemitting diode 44 to view the tightly bunched rays and far away from the opposite portion of the side wall 38 to reduce the possibility of reflected light falling on the photodiode detector 28. The combination of the location of the shielding arrangement 54 with the mounting of the photodiode detector 28 on the circuit board 22 and the location of photoemitting diode 44 in the mounting arrangement 42 provides for a very broad field of view of the photodiode detector 28 and hence increased sensitivity without having to resort to the provision of additional optical elements such as lenses for focusing of the light. This expanded field of view of the photodiode detector 28 provides for a large area of intersection with the light beam 48 of the photoemitting diode 44 to define the detection volume.

In operation, when smoke particles enter the smoke detector 10 through the openings 18 provided in the cover 16 and then through the openings provided in the labyrinth side wall 38 of the smoke detection chamber 30, the smoke particles fall within the light beam 48 of the photoemitting diode 44. Smoke particles which are present in the detection volume defined by the area of intersection of the light beam 48 from the photoemitting diode 44 and the field of view of the photodiode detector 28, cause the light from the photoemitting diode 44 to be scattered such that it is directed through the shielding arrangement 54 and on to the photodiode detector 28. When the amount of light detected by the photodiode detector 28 passes a predetermined threshold, the smoke alarm circuitry is activated and the detector indicates the alarm condition in the usual manner.

A prototype smoke detector of the present invention as illustrated in the Figures, has been constructed having a smoke detection chamber 30 as shown in FIG. 3 in which the photoemitting diode 44 and photodiode detector 28 are mounted in the large circular cylinder having an outside diameter of 2.3 inches. The photoemitting diode 44 broadcasts across the chamber 30 at an 8° down angle and the photodiode detector 28 views axially with an 82° scattering angle from its mounting position directly on the printed circuit board 22 with the centerline of the photodiode detector 28 and shielding arrangement 54 being located 0.356 inches away from the end of the mounting arrangement 42. The prototype utilized a Siemens BPW34FA silicon photodiode, a polysulfone-bodied detector with visible light rejection characteristics. The photoemitting diode utilized was a Siemens SFH484 light emitting diode which operates at a wavelength of 880 nm in the infrared range. The alarm and control circuitry employed a Motorola MC145010 IC chip along with required circuitry for operation. The prototype alarm exhibited a high sensitivity and high RFI immunity to false alarms through the UV spectrum to 1 GHz. The large smoke detection chamber with the double vane side wall 38 and reticulated top 36 achieved low background reflection with good dust hiding capability. The prototype design of the preferred embodiment of the present invention had a normalized figure of merit (NFM) which is a measure of the smoke detection sensitivity to background reflection ratio greater than unity. This translates to smoke alarm signals being at least three times greater than the background reflection for alarm point settings of three percent per foot obscuration. This high NFM affords exceptional immunity to false alarms from dust accumulation.

Excellent smoke access to the smoke detection chamber 30 is afforded by the smoke detection chamber 30 having the double wall labyrinth 38 around its periphery with minimal interruption or blockage of the labyrinth by the mounting arrangement 42. This arrangement of the smoke detection chamber 30 achieves sensitivities within about five percent variation between smoke directed at the chamber at the mounting arrangement 42 as compared to smoke directed at the chamber in the labyrinth side walls 38. The smoke detector 10 is vented around the circular periphery both at the top and the bottom and also utilizes disruptive vanes to turbulate laminar smoke flow. The design of both the chamber 30 and the case provides for disruption of laminar smoke flow associated with low air velocity and dead air typical of smoldering fire conditions. The design of the present invention has smoke detection sensitivities of both low and high air velocity within ten percent of each other thus indicating the detector's excellent smoke entry design and the positioning of the detection volume defined by the intersection of the transmitted light from the photoemitting diode and the view of the photodiode detector.

The provision of the surface mounted photodiode detector 28 allows the detector to be mounted directly to the printed circuit board 22 along with the other surface mounted devices in a single step, thus reducing manufacturing costs. The surface mounted photodiode detector 28 is able to view downwards through the shielding arrangement 54 of the smoke detection chamber 30 directly at the smoke reaction volume. This smoke reaction volume is located in the lower portion of the smoke detection chamber 30 immediately accessible to the smoke flow.

The smoke detector of the present invention improves alarm response consistency and reduces manufacturing steps and costs. The design of the smoke detector as described herein provides for a very uniform detection sensitivity for various smoke types and colors under varying conditions with high RFI immunity. To further increase the RFI immunity of the smoke detector, the photodiode detector 28 may be mounted on the side of the circuit board opposite the smoke chamber along with the other SMT components. In this situation an aperture may be provided in the circuit board between the photodiode detector 28 and the shielding arrangement 54 on the bottom 32 of the smoke detection chamber 30 such that the photodiode detector 28 views into the smoke chamber 30 through the aperture in the circuit board and the shielding arrangement 54 on the bottom of the smoke detection chamber 30.

Although various preferred embodiments of the present invention have been described herein in detail, it will be appreciated by those skilled in the art that variations may be made thereto without departing from the spirit of the invention or the scope of the appended claims.

The embodiments of the invention in which an exclusive property or privilege is claimed are as follows:

1. A photoelectric smoke detector comprising a case having mounted therein a circuit board and a smoke detection chamber having a side wall with a double row of generally rectangular vanes arranged to provide a labyrinth extending generally around the entire side wall for ingress and egress of smoke particles, a top and a bottom, a photoemitting diode mounted in a mounting arrangement in the side wall of the smoke detection chamber so that a light beam from the photoemitting diode is transmitted across the smoke detection chamber, the mounting arrangement extending and spaced away from the bottom to provide minimal interference for entry of smoke particles, the bottom of the smoke detection chamber having an opening therein with a shielding arrangement thereabout open to the chamber, the circuit board being mounted to overlie the bottom surface and including a photodiode detector mounted directly thereon and positioned generally in the opening so that it views into the smoke detection chamber through the opening and through the shielding arrangement, the shielding arrangement shielding the photodiode detector from incident light which may be present in the smoke detector chamber while providing for a diverging field of view of the photodiode detector which intersects the light beam of the photoemitting diode to define a detection volume contained within the smoke detection chamber, whereby the double vane side wall and spacing of the mounting arrangement from the bottom provides the smoke detection chamber with generally uniform smoke penetration properties around its entire periphery such that there is about a 5% or less variation in ability of smoke particles to penetrate the smoke detection chamber at any point around the periphery of the smoke detection chamber.

2. A photoelectric smoke detector as claimed in claim 1 wherein the photodiode detector and photoemitting diode are mounted to have a generally perpendicular scattering angle therebetween.

3. A photoelectric smoke detector according to claim 2 wherein the mounting arrangement for a photoemitting diode is a generally cylindrical tunnel to surround a photoemitting diode, the mounting arrangement being mounted on a vane extending upwardly from the bottom to space the mounting arrangement away from the bottom.

4. A photoelectric smoke detector according to claim 3 wherein the double row of generally rectangular vanes includes an outer row of vanes extending inwardly at an acute angle from the exterior of the smoke detection chamber.

5. A photoelectric smoke detector according to claim 4 wherein the double row of generally rectangular vanes includes an inner row of vanes spaced away from the outer row and extending inwardly at an acute angle opposite the acute angle of the outer row.

6. A photoelectric smoke detector according to claim 5 wherein the double row of rectangular vanes are oriented such that extending a plane of a vane of one row of vanes intersects the other row of vanes inwardly of an end of the vane.

7. A smoke detection chamber for use in a photoelectric smoke detector, the smoke detection chamber comprising a side wall with a double row of generally rectangular vanes arranged to provide a labyrinth extending generally around the entire side wall for ingress and egress of smoke particles, a top and a bottom, a mounting arrangement for a photoemitting diode being provided in the side wall of the smoke detection chamber so that a light beam from a photoemitting diode is transmitted across the smoke detection chamber, the mounting arrangement extending from and being spaced away from the bottom to provide minimal interference for entry of smoke particles, the bottom of the smoke detection chamber having an opening therein with a shielding arrangement thereabout open to the chamber for a photodiode detector, the double vane side wall and spacing of the mounting arrangement from the bottom provides the smoke detection chamber with generally uniform smoke penetration properties around its entire periphery such that there is about a 5% or less variation in ability of smoke particles to penetrate the smoke detection chamber at any point around the periphery of the smoke detection chamber.

8. A smoke detection chamber according to claim 7 wherein the mounting arrangement for a photoemitting diode is a generally cylindrical tunnel to surround a photoemitting diode, the mounting arrangement being mounted on a vane extending upwardly from the bottom to space the mounting arrangement away from the bottom.

9. A smoke detection chamber according to claim 8 wherein the double row of generally rectangular vanes includes an outer row of vanes extending inwardly at an acute angle from the exterior of the smoke detection chamber.

10. A smoke detection chamber according to claim 9 wherein the double row of generally rectangular vanes includes an inner row of vanes spaced away from the outer row and extending inwardly at an acute angle opposite the acute angle of the outer row.

11. A smoke detection chamber according to claim 10 wherein the double row of rectangular vanes are oriented such that extending a plane of a vane of one row of vanes intersects the other row of vanes inwardly of an end of the vane.

12. A smoke detection chamber comprising a bottom having an opening and shielding arrangement for a photodiode detector and a vane extending upwardly to which is attached a mounting arrangement for a photoemitting diode and a cover having a double row of rectangular vanes extending downwardly from a top surface, the cover being releasably attachable to the bottom to form the smoke detection chamber, whereby the double row of rectangular vanes and vane to space the mounting arrangement from the bottom provides the smoke detection chamber with generally uniform smoke penetration properties around its entire periphery.

13. A smoke detection chamber according to claim 12 wherein the double row of generally rectangular vanes includes an outer row of vanes extending inwardly at an acute angle from the exterior of the smoke detection chamber.

14. A smoke detection chamber according to claim 13 wherein the double row of generally rectangular vanes includes an inner row of vanes spaced away from the outer row and extending inwardly at an acute angle opposite the acute angle of the outer row.

15. A smoke detection chamber according to claim 14 wherein the double row of rectangular vanes are oriented such that extending a plane of a vane of one row of vanes intersects the other row of vanes inwardly of an end of the vane.

* * * * *